US009874223B2

(12) United States Patent
Theratil et al.

(10) Patent No.: US 9,874,223 B2
(45) Date of Patent: Jan. 23, 2018

(54) DIFFUSER PIPE FOR A GAS TURBINE ENGINE AND METHOD FOR MANUFACTURING SAME

(71) Applicant: Pratt & Whitney Canada Corp., Longueuil (CA)

(72) Inventors: Ignatius Theratil, Mississauga (CA); Aldo Abate, Longueuil (CA); Krishna Prasad Balike, Mississauga (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 406 days.

(21) Appl. No.: 14/138,807

(22) Filed: Dec. 23, 2013

(65) Prior Publication Data

US 2014/0369814 A1 Dec. 18, 2014

Related U.S. Application Data

(60) Provisional application No. 61/835,701, filed on Jun. 17, 2013.

(51) Int. Cl.

| | |
|---|---|
| ***F16L 9/00*** | (2006.01) |
| ***F04D 29/44*** | (2006.01) |
| ***F04D 29/66*** | (2006.01) |
| ***F01D 9/02*** | (2006.01) |

(52) U.S. Cl.

CPC ..... *F04D 29/441* (2013.01); *F01D 9/02* (2013.01); *F04D 29/668* (2013.01); *Y10T 29/49316* (2015.01)

(58) Field of Classification Search

CPC ..... F04D 29/661; F04D 29/441; F04D 29/601

USPC ..... 138/39, 109, 177

See application file for complete search history.

(56) References Cited

U.S. PATENT DOCUMENTS

| | | | | |
|---|---|---|---|---|
| 1,901,897 | A * | 3/1933 | Clayton | H02G 3/06 285/149.1 |
| 2,509,782 | A * | 5/1950 | Person, Jr. | B21C 37/28 285/183 |
| 2,735,612 | A | 2/1956 | Hausmann | |
| 3,144,202 | A | 8/1964 | Helmbold | |
| 3,289,921 | A | 12/1966 | Soo | |
| 3,578,264 | A | 5/1971 | Kuethe | |
| 3,644,055 | A | 2/1972 | Davis | |
| 3,920,271 | A * | 11/1975 | Bluestone | F24F 13/02 285/148.22 |
| 4,098,073 | A | 7/1978 | Adkins et al. | |
| 4,100,732 | A | 7/1978 | Bryans et al. | |

(Continued)

FOREIGN PATENT DOCUMENTS

| | | |
|---|---|---|
| RU | 2103560 | 1/1998 |
| SU | 311050 | 10/1971 |
| SU | 1308781 | 5/1987 |

*Primary Examiner* — Vishal Pancholi

(74) *Attorney, Agent, or Firm* — Norton Rose Fulbright Canada LLP

(57) ABSTRACT

A diffuser pipe for a gas turbine engine comprises a hollow pipe body including a first end, a second end fluidly connected to the first end, and at least one flattened area proximate to the second end. A ring is connected to the second end. The ring is an outlet of the diffuser pipe. At least one stiffener is disposed on the at least one flattened area. The ring and the at least one stiffener reduce vibratory stresses at the second end of the pipe body. A method of manufacturing a diffuser pipe of a gas turbine engine is also presented.

21 Claims, 6 Drawing Sheets

(56) References Cited

U.S. PATENT DOCUMENTS

| | | | | |
|---|---|---|---|---|
| 4,272,955 | A | 6/1981 | Hoffman et al. | |
| 4,431,374 | A | 2/1984 | Benstein et al. | |
| 4,497,445 | A | 2/1985 | Adkins et al. | |
| 4,696,622 | A | 9/1987 | Traczyk et al. | |
| 4,796,429 | A | 1/1989 | Verdouw | |
| 4,979,361 | A | 12/1990 | Clark et al. | |
| 5,387,081 | A | 2/1995 | Leblanc | |
| 5,495,873 | A * | 3/1996 | Butkiewicz | F01N 13/141 138/114 |
| 5,564,898 | A | 10/1996 | Richards et al. | |
| 6,471,475 | B1 | 10/2002 | Sasu et al. | |
| 6,540,481 | B2 | 4/2003 | Moussa et al. | |
| 6,589,015 | B1 | 7/2003 | Roberts et al. | |
| 6,647,730 | B2 | 11/2003 | Liu | |
| 7,101,151 | B2 | 9/2006 | Loringer et al. | |
| 7,156,618 | B2 | 1/2007 | Fish et al. | |
| 8,425,188 | B2 | 4/2013 | Dovbush et al. | |
| 2006/0104809 | A1 | 5/2006 | Fish et al. | |
| 2008/0092975 | A1 * | 4/2008 | Grimes | F16L 43/001 138/177 |
| 2009/0269139 | A1 * | 10/2009 | McBride | F15D 1/02 405/80 |
| 2010/0278643 | A1 | 11/2010 | Leblanc et al. | |

* cited by examiner

DIFFUSER PIPE FOR A GAS TURBINE ENGINE AND METHOD FOR MANUFACTURING SAME

RELATED APPLICATIONS

The present application claims priority on U.S. provisional patent application No. 61/835,701 filed on Jun. 17, 2013.

TECHNICAL FIELD

The application relates generally to gas turbine engines and, more particularly, to diffuser pipes.

BACKGROUND OF THE ART

Diffuser pipes are provided in gas turbine engines for directing flow of compressed air from the centrifugal compressor impeller to an annular chamber containing the combustor. Diffuser pipes are typically made from sheet metal and may be sensitive to vibratory stresses as a result of the engine operation.

SUMMARY

In one aspect, there is provided a diffuser pipe for a gas turbine engine, the diffuser pipe comprising: a hollow pipe body including: a first end; a second end fluidly connected to the first end; and at least one flattened area proximate to the second end; a ring connected to the second end, the ring being an outlet of the diffuser pipe; and at least one stiffener disposed on the at least one flattened area, the ring and the at least one stiffener reducing vibratory stresses at the second end of the pipe body.

In another aspect, there is provided a method of manufacturing a diffuser pipe of a gas turbine engine, the method comprising: forming a hollow diffuser pipe body from at least one sheet metal; adding a raised structure on a flat portion of the diffuser pipe body near an end of the diffuser pipe body; and connecting a unitary formed ring to the end of the diffuser pipe body.

DESCRIPTION OF THE DRAWINGS

Reference is now made to the accompanying figures in which.

DETAILED DESCRIPTION

Figure 1:
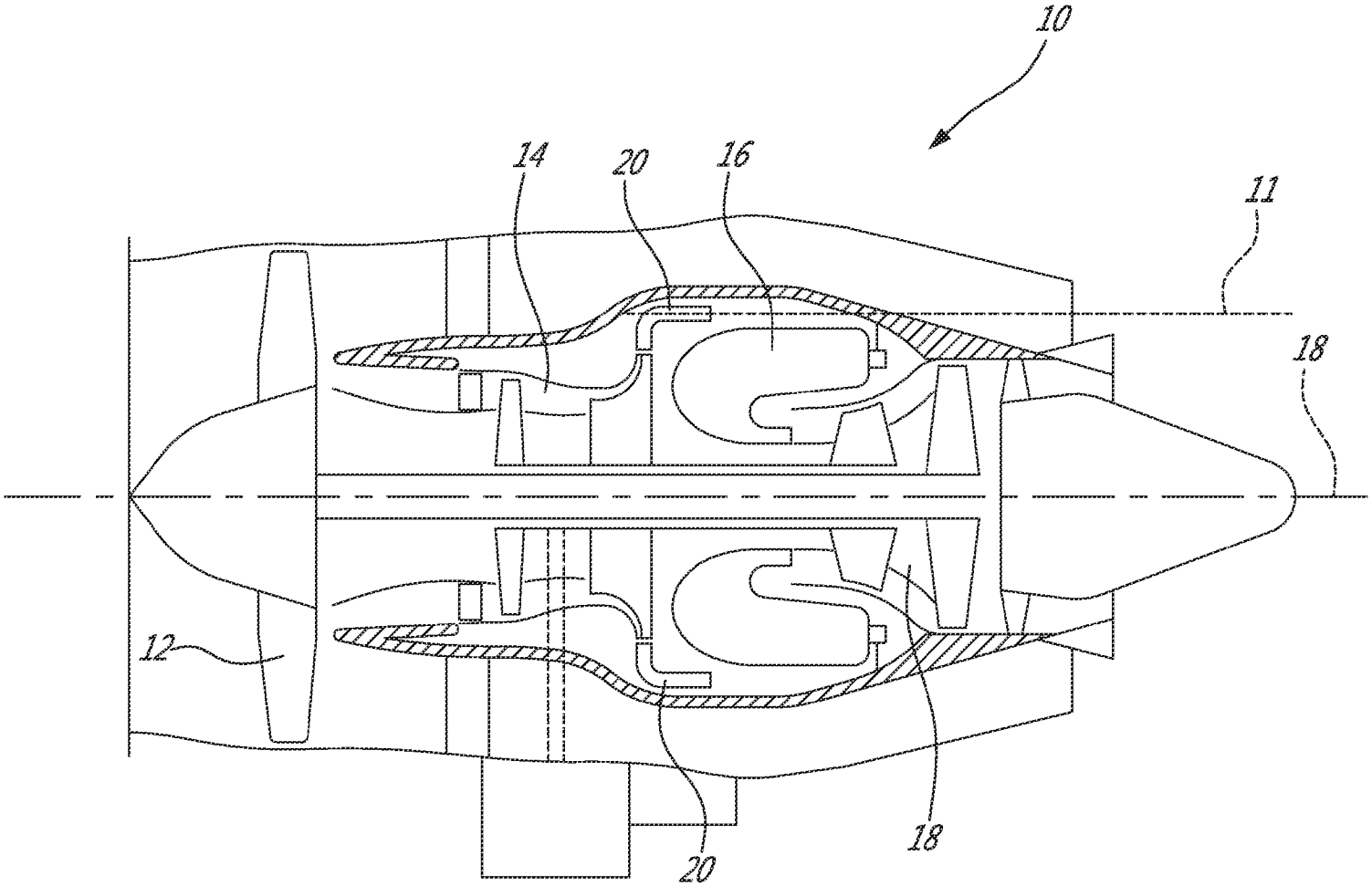
FIG. 1 is a schematic cross-sectional view of a gas turbine engine.

FIG. 1 illustrates a gas turbine engine 10 of a type preferably provided for use in subsonic flight, generally extending along a longitudinal axis 18. The engine 10 includes in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. A number of diffuser pipes 20 are provided for directing flow of compressed air from the centrifugal compressor impeller of the compressor section 14 to an annular chamber or plenum containing the combustor 16. The diffuser pipes 20 are connected of a common diffuser case (not shown).

Figure 2:
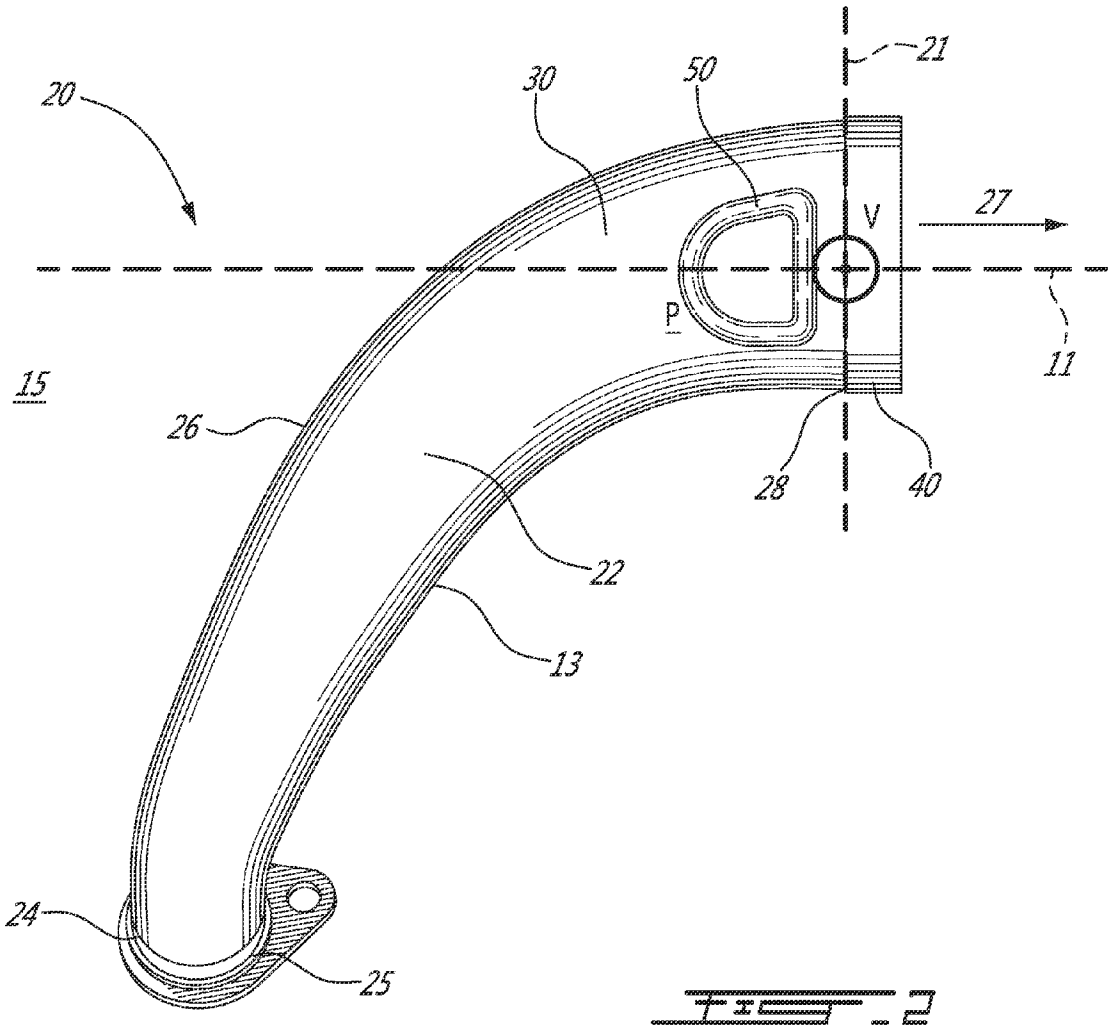
FIG. 2 is a front perspective view of a diffuser pipe according to one embodiment for the gas turbine engine of FIG. 1.
Figure 3:
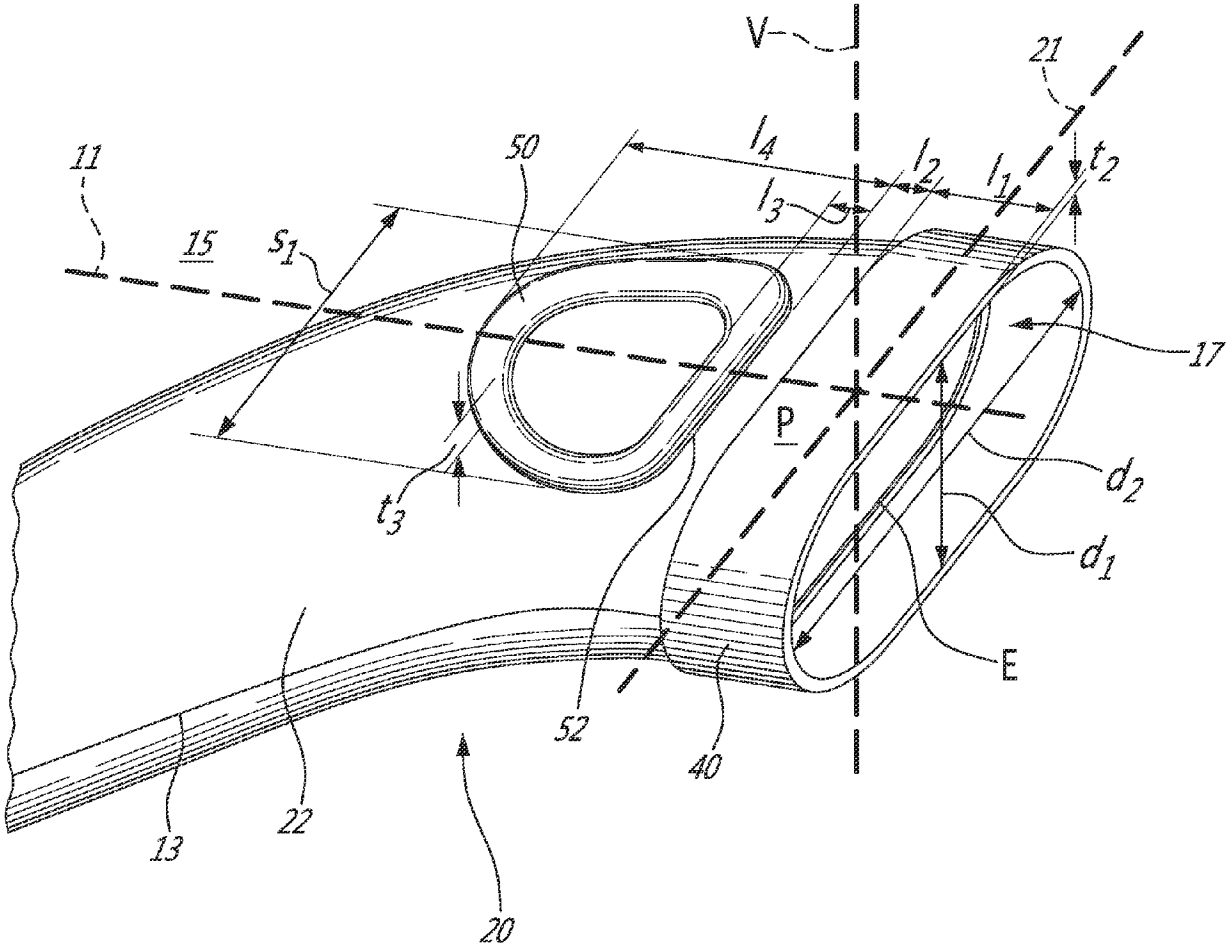
FIG. 3 is a top perspective view of a front portion of a diffuser pipe according to another embodiment for the gas turbine engine of FIG. 1.

Referring to FIG. 2, each diffuser pipe 20 has a body 22 made of two formed sheet metals. In the embodiment shown herein, the sheet metals are welded to each other. A weld line 13 is best shown in FIG. 3. It is contemplated that the diffuser pipes could be stamped, hydroformed, cast or machined. The sheet metals have each a thickness t1 (not shown). In the embodiment shown herein, t1 is 0.035 inches.

The body 22 of the diffuser pipe 20 includes a first end 24, a second end 28 fluidly connected to the first end 24, and a curvature 26 disposed between the first end 24 and the second end 28. The first end 24 is welded to a ferrule 25, which connects the diffuser pipe 20 to the diffuser case by bolting. It is contemplated that the diffuser pipe 20 could be connected to the diffuser case by brazing as well. The first end 24 is an inlet of the diffuser pipe 20. The second end 28 is an outlet of the diffuser pipe 20 and also known as the "lip" of the diffuser pipe 20. The second end 28 of the diffuser pipe 20 discharges the compressed air in a direction of the longitudinal axis 18 of the engine 10 (see arrow 27). For orientation purposes, an axis perpendicular to the second end 28 at the lip 28 will be referred to as a first axis 21, and an axis in the direction of the second end 28 at the lip 28 will be referred to as a second axis 11. In the embodiment shown herein, the second axis 11 is parallel to the longitudinal axis 18 of the engine 10. The first and second axes 21 and 11 form a plane P, a perpendicular axis/line to the plane P will herein be referred as a vertical V.

A ring 40 is connected to the lip 28 and forms a free end of the diffuser pipe 20. The ring 40 is shown herein to be connected to an outside 15 of the diffuser pipe 20 but could be connected to an inside 17 of the diffuser pipe 20. The ring 40 acts as a stiffener to the diffuser pipe 20 which may be vulnerable to vibratory stresses as a result of the engine 10 operation. The diffuser pipe 20 has one or more natural frequencies that may be in the range of the vibration frequencies of the engine 10 (generally high frequencies). The ring 40 stiffens the diffuser pipe 20 and reduces the vibratory stresses of higher natural modes of the diffuser pipe 20 at the lip 28 (i.e. lip modes) during engine 10 operation. In turn, the diffuser pipe 20 may be less prone to early fractures (a.k.a. lip modes failure).

The ring 40 is unitary formed (e.g. through machining or casting). By being unitary formed, the ring 40 reduces vibratory stresses compared to non-unitary formed rings (e.g. welded). In the embodiment shown herein, the ring 40 is unitary formed by machining. It is contemplated that other fabrication methods could be used to form the unitary ring 40. For example, the ring 40 could be cast.

The ring 40 has a width I1 (shown in FIG. 3) in a direction of the second axis 11, and a thickness t2 (shown in FIG. 3). In the embodiment shown herein, t2 is 0.070 inches and I1 is 0.500 inches. The thickness t2 is larger than the thickness t1 of the diffuser pipe 20. However, it is contemplated that the ring 40 could have the thickness t2 smaller than the thickness t1 of the diffuser pipe 20. While various choices of t2 and t1 can provide stiffening of the diffuser pipe 20, a ratio t2/t1 is preferably comprised between 0.25 and 3 to provide vibratory stress reduction. There are several factors that contribute to a reduction of stresses at the lip 28 due the presence of a ring such as the ring 40. One factor is the thickness t1 of the ring 40 relative to the thickness t2 of the diffuser pipe 20. A ring with a greater thickness than the diffuser pipe reduces stresses at the lip. Another factor is the presence of connecting points such as welds to form the ring. A unitary ring such as the ring 40 reduces stresses experienced by the ring itself during vibration, as welds are sources of potential local high stresses. In view of the above, there could be cases where a unitary ring having a thickness smaller than a thickness of the diffuser pipe would act as a stiffener to the diffuser pipe despite its relative thinness. There could also be cases where a welded ring having a thickness greater than a thickness of the diffuser pipe would act as a stiffener to the diffuser pipe. But the vibratory stress reduction of such ring may be less than the one of the thinner welded ring. However, a welded ring having a thickness smaller than a thickness of the diffuser pipe may not reduce vibratory stresses to the desired levels.

The body 22 has two flattened areas 30 facing each other (only one flattened area 30 being shown in the Figures). As a result, a cross-section of the lip 28 is a generally flattened elliptical cross-section E. A longer diameter of the flattened ellipse E is d2, and a smaller diameter of the flattened ellipse E is d1 (both shown in FIG. 3). In the embodiment shown herein, the longer diameter d2 is in the direction of the first axis 21, while the shorter diameter d1 is in a direction of the vertical V. In the embodiment shown herein, d1 is 1.181 inches and d2 is 2.102 inches. It is contemplated that the flattened areas 30 could not be totally flat but could have some curvature.

Each flattened area 30 includes a stiffener 50. The stiffener 50, which may have various shapes as described below, is a raised portion of the flattened area 30 (when seen from an outside 15 of the diffuser pipe 20). The stiffener 50 may sometimes be known as "dimples" although when seen from the outside 15 of the diffuser pipe 20, they are raised. However, when seen from the inside 17 of the diffuser pipe 20, the stiffener 50 is a local depression. The stiffener 50 is raised at a distance t3 vertically from a rest of the flattened area 30. In the embodiment shown herein, the raised distance t3 is 0.060 inches. While various choices of t3 and t1 can provide stiffening of the diffuser pipe 20, a ratio t3/t1 is preferably comprised between 0.25 and 3 to provide vibratory stress reduction. The stiffener 50 is made by stamping the flattened area 30. It is contemplated, however, that the stiffener 50 could be added to the diffuser pipe 20, and as such be full. It would then remain a raise when seen from the outside 15 of the diffuser pipe 20, and would be flat when seen from the inside 17 of the diffuser pipe 20. It is contemplated that the stiffener 50 could be a depression portion of the flattened area 30 instead of being a raise. Although the stiffener 50 is described herein to be on both flattened areas 30 of the diffuser pipe 20, it is contemplated that the stiffener 50 could be on only one of the two flattened areas 30.

The presence of the stiffener 50 on the flattened area 30 of the diffuser pipe 20 reduces vibratory stresses for high dynamic modes of vibration of the diffuser pipe 20 during the engine 10 operation, similarly to what has been discussed above for the ring 40. While the ring 40 reduces stresses at the lip 28, the stiffener 50 reduces stresses upstream of the ring 40 in the flattened area 30. The combined use of the stiffener 50 and the ring 40 ensures a vibratory stress reduction of the diffuser pipe 20 greater than the individual contribution of the stiffener 50 and the ring 40.

Turning now to FIG. 3, the stiffener 50 will now be described in details. The stiffener 50 is one example of stiffener that could be applied to a diffuser pipe. Other examples of stiffeners are given below.

The stiffener 50 is D-shaped, with a straight portion 52 of the D parallel to the ring 40. Although the straight portion 52 is shown herein to be parallel to the ring 40, it is contemplated that the straight portion 52 could be at an angle with the ring 40. For example, the straight portion 52 could make an angle of 10 degrees with the ring 40. A shape, size and orientation of the straight portion 52 is linked to the stiffening properties of the stiffener 50. For example, stiffening may be reduced when the straight portion 52 is at an angle with the ring 40. A distance l2 of the straight portion 52 to the ring 40 in a direction of the second axis 11 influences a stiffening of the diffuser pipe 20. A shorter distance l2 was found to increase the stiffening of the diffuser pipe 20. Although the distance l2 is desired to be short, it is not zero, i.e. the stiffener 50 does not abut the ring 40. In the embodiment shown in FIG. 3, l2 is 0.142 inches. While various choices of l1 and l2 can provide stiffening of the diffuser pipe 20, a ratio l1/l2 is preferably comprised between 1.2 and 3.5 to provide vibratory stress reduction.

Figure 7:
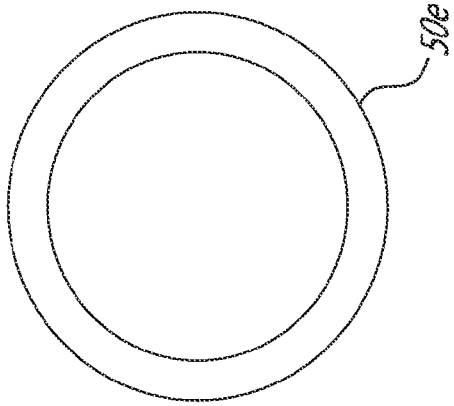
FIGS. 5 to 10 are schematics of different shapes of stiffeners for a diffuser pipe such as the ones of FIG. 3 or FIG. 4.
Figure 6:
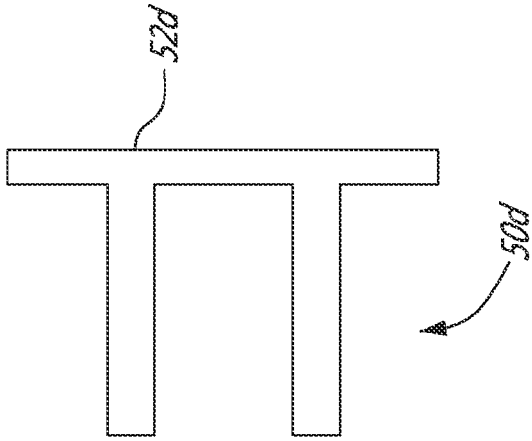
Figure 5:
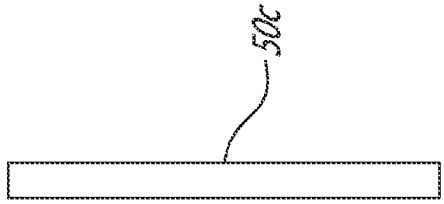
Figure 9:
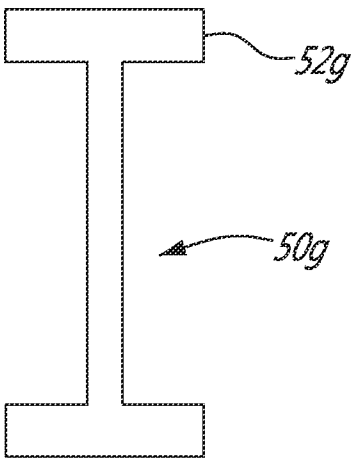
Figure 8:
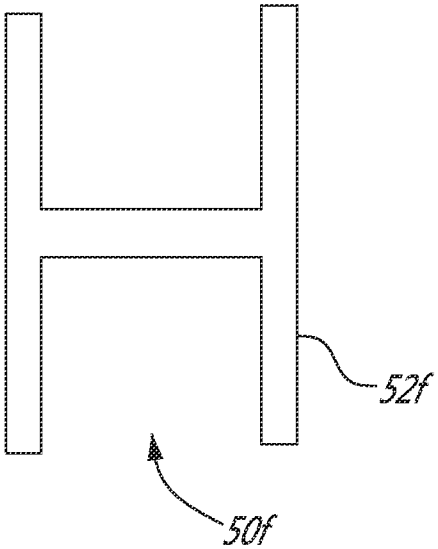
Figure 10:
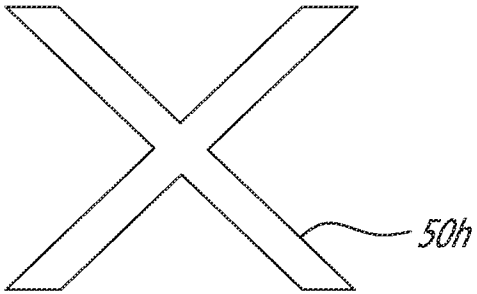

The straight portion 52 has a span s1 in the direction 21. In the embodiment shown in FIG. 3, s1 is 1.368 inches. It is been observed that a larger span s1 increases stiffening of the diffuser pipe 20. While various choices of d2 and s1 can provide stiffening of the diffuser pipe 20, a ratio d2/s1 is preferably comprised between 1.2 and 1.6 to provide vibratory stress reduction. It is contemplated that a portion of the stiffener 50, closest to the ring 40 could not be straight. For example, it could be an O-shaped stiffener such as the one shown in FIG. 7. In such cases, vibratory stresses may not be reduced.

A thickness of the stiffener 50 is determined by parameter l3, defined as a thickness of the straight portion 52 in a direction of the second axis 11. In the embodiment shown in FIG. 3, l3 is 0.270 inches. While various choices of l3 and t3 can provide stiffening of the diffuser pipe 20, a ratio l3/t3 is preferably comprised between 4.5 and 5 to provide vibratory stress reduction. It is contemplated that the ratio l3/t3 could have other values, yet not zero.

A width of the stiffener 50 is determined by parameter l4, defined as a span of the stiffener 50 in the direction of the second axis 11. In the embodiment shown in FIG. 3, l4 is 1.190 inches. While various choices of l4 and d1 can provide stiffening of the diffuser pipe 20, a ratio l4/d1 is preferably comprised between 1 and 1.25 to provide vibratory stress reduction.

Figure 4:
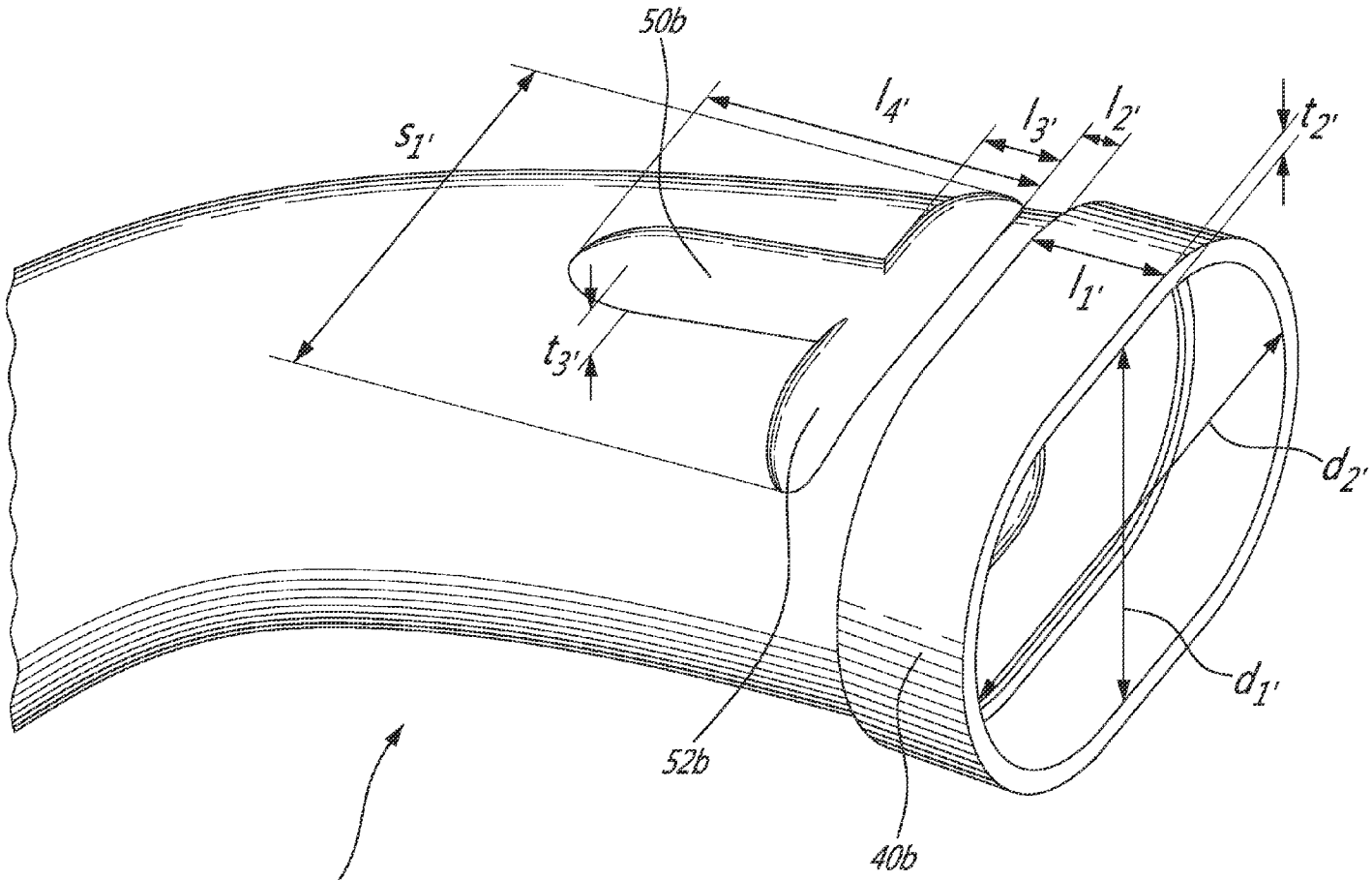
FIG. 4 is a top perspective view of a front portion of a diffuser pipe according to yet another embodiment for the gas turbine engine of FIG. 1.

Turning now to FIG. 4, a second embodiment of a stiffener **50*b* will now be described on a diffuser pipe 20*b* having a ring 40*b*. The diffuser pipe 20*b* and ring 40*b* are similar to the diffuser pipe 20 and ring 40 but have different dimensions: d1' is 1.033 inches, d2' is 1.625 inches, and l1' of 0.400 inches. It is contemplated that the diffuser pipe 20*b* and ring 40*b* could have the same dimensions as the diffuser pipe 20 and ring 40**.

The stiffener **50*b* is similar to the stiffener 50, but has a T-shape instead of a D-shape. As such, the stiffener 50*b* will not be described in details herein again. The stiffener 50*b* includes a straight portion 52*b* parallel to the ring 40*b*. This straight portion 52*b* is similar to the straight portion 52, and achieves similar vibratory stress reduction properties as the straight portion 52 does. Designs parameters t1', t2', t3', d1', d2', I1', I2', I3', I4', s1' are defined similarly as the designs parameters t1, t2, t3, d1, d2, I1, I2, I3, I4, s1 of the stiffener 50. In the embodiment of the diffuser pipe 20***b* shown in FIG. 4, I2' is 0.149 inches, I3' is 0.281 inches, I4' is 1.166 inches, and s1' is 1.272 inches. The designs parameters t1', t2', t3', d1', d2', I1', I2', I3', I4', s1' may have the same values as the designs parameters t1, t2, t3, d1, d2, I1, I2, I3, I4, s1, or may have different values as long as they are kept within the ranges for the ratios described above.

FIGS. 5 to 10 show yet other shapes of stiffeners to be used with the diffuser pipes 20, 20*b*, or any other diffuser pipes for gas turbine engines. The stiffener 50*c* is a straight line and preferably disposed parallel to the ring. The stiffener 50*d* is Pi-shaped and has a straight portion 52*d* preferably disposed parallel to the ring 40. The stiffener 50*e* is O-shaped. The stiffener 50*f* is H-shaped and has a straight portion 52*f* preferably disposed parallel to the ring. The stiffener 50*g* is I-shaped and has a straight portion 52*g* preferably disposed parallel to the ring. The stiffener 50*h* is X-shaped. The X-shape stiffener 50*h* is preferably oriented to have a top of one of the V forming the X parallel to the ring. Designs parameters of the stiffeners 50*c*, 50*d*, 50*e*, 50*f*, 50*g*, 50*h* are similar to and may have same values as the designs parameters t1, t2, t3, d1, d2, I1, I2, I3, I4, s1 of the stiffeners 50 or 50*b*. All the stiffeners 50*c* to 50*h* shown on FIGS. 5 to 10 are schematics. Corners between the different components of each of the stiffeners 50*c* to 50*h* are smoothen out to avoid high local stresses and for manufacturability requirements. The same holds for stiffeners 50 and 50*b*.

Using a stiffener or a ring on the flat portion of the diffuser pipe as described above, may reduce vibratory stress compared to diffuser pipes having no such stiffener or ring. In addition, the diffuser pipes having the stiffener and the ring were found to be undergoing less vibratory stresses than the diffuser pipes having only the stiffener and only the ring, or those having no ring and no stiffener. The ring and stiffener work in combination to reduce vibratory stresses, especially when designed using the ratios described above. Shapes and positions of the stiffener and ring are determined analytically so as to reduce vibratory stresses on the diffuser pipe by calculating the stresses for the lip mode(s). For example, diffuser pipes having the ring and a D-shaped stiffener such as the stiffener 50 underwent a reduction of 36% of vibratory stresses compared to same diffuser pipes having no ring and a T-shaped stiffener such as the stiffener 50*b*. The above described stiffeners can be added to existing diffuser pipes without the need to replace the diffuser pipe. The formation of the stiffener and the welding of the ring can be performed without undue burden.

The above description is meant to be exemplary only, and one skilled in the art will recognize that changes may be made to the embodiments described without departing from the scope of the invention disclosed. The diffuser pipes described herein have been shown for a gas turbine engine for use in subsonic flight. It is however contemplated that the diffuser pipe could be used in other types of engines and in supersonic flights. Examples of such engines include: auxiliary power unit, turbofan engines, turboshaft engines and turbo prop engines. Any of the described stiffeners may be oriented relative to the ring differently from described herein, with a repercussion on the vibratory stress reduction of the diffuser pipe. Vibratory stress reduction properties of those stiffeners that have their straight portion at an angle relative to the ring may be reduced compared to those stiffeners that have their straight portion parallel to the ring. Any of the described stiffeners may be disposed more or less away relative to the ring. Vibratory stress reduction properties those stiffeners that are away from the ring may also be reduced compared to those stiffeners that are close to the ring. The diffuser pipe may have more than one stiffener on each flattened area. Still other modifications which fall within the scope of the present invention will be apparent to those skilled in the art, in light of a review of this disclosure, and such modifications are intended to fall within the appended claims.

The invention claimed is:

1. A diffuser pipe for a gas turbine engine, the diffuser pipe comprising:

a hollow pipe body including:

a first end connected to a diffuser case, the first end defining an inlet cross-sectional area of the diffuser pipe;

a second end fluidly connected to the first end, the second end being a free end and defining an outlet cross-sectional area of the diffuser pipe, the outlet cross-sectional area being greater than the inlet cross-sectional area; and at least one flattened area proximate to the second end;

a ring connected to the second end, the ring being an outlet of the diffuser pipe; and at least one stiffener disposed on the at least one flattened area, the ring and the at least one stiffener reducing vibratory stresses at the second end of the pipe body.

2. The diffuser pipe as defined in claim 1, wherein the at least one stiffener is a raise relative to the at least one flattened area.

3. The diffuser pipe as defined in claim 1, wherein the at least one flattened area includes two flattened areas facing each other and forming a flattened elliptical cross-section at the second end.

4. The diffuser pipe as defined in claim 1, wherein the at least one stiffener is stamped to the at least one flattened area.

5. The diffuser pipe as defined in claim 1, wherein the at least one stiffener includes a straight portion.

6. The diffuser pipe as defined in claim 5, wherein the straight portion is disposed parallel to the ring.

7. The diffuser pipe as defined in claim 5, wherein the straight portion is proximate to the ring.

8. The diffuser pipe as defined in claim 1, wherein the ring is unitary formed.

9. The diffuser pipe as defined in claim 1, wherein the ring is machined.

10. The diffuser pipe as defined in claim 1, wherein the second end is disposed on a first axis;

a second axis is perpendicular to the first axis, the first and second axes being generally in plane with the at least flattened area;

the pipe body has a first thickness;

the ring has a second thickness; and a ratio of the second thickness to the first thickness is comprised between 0.25 and 3.

11. The diffuser pipe as defined in claim 2, the second end is disposed on a first axis;

a second axis is perpendicular to the first axis, the first and second axes being generally in plane with the at least flattened area;

the pipe body has a first thickness ;

the at least one stiffener raises at a second thickness relative to the at least one flattened area in a direction perpendicular to the first and second axes; and a ratio of the second thickness to the first thickness is comprised between 0.25 and 3.

12. The diffuser pipe as defined in claim 3, wherein the second end is disposed on a first axis;

a second axis is perpendicular to the first axis, the first and second axes being generally in plane with the at least flattened area;

the ring has a width along the second axis;

the flattened ellipsoid has a short diameter in a direction perpendicular to the first and second axes; and a ratio of the short diameter to the width of the ring is comprised between 1 and 4.

13. The diffuser pipe as defined in claim 3, wherein the second end is disposed on a first axis;

a second axis is perpendicular to the first axis, the first and second axes being generally in plane with the at least flattened area;

the at least one stiffener has a span in a direction of the first axis;

the flattened ellipsoid has a long diameter along the first axis; and a ratio of the long diameter to the span of the stiffener is comprised between 1.2 and 1.6.

14. The diffuser pipe as defined in claim 3, wherein the second end is disposed on a first axis;

a second axis is perpendicular to the first axis, the first and second axes being generally in plane with the at least flattened area;

the ring has a width in a direction of the second axis;

the at least one stiffener is disposed at a first distance from the ring in the direction of the second axis; and a ratio of the width of the stiffener to the first distance is comprised between 1.2 and 3.5.

15. The diffuser pipe as defined in claim 3, wherein the second end is disposed on a first axis;

a second axis is perpendicular to the first axis, the first and second axes being generally in plane with the at least flattened area;

the at least one stiffener has a width in a direction of the second axis;

the flattened ellipsoid has a short diameter perpendicular to the long diameter; and a ratio of the span of the at least one stiffener to the short diameter is comprised between 1 and 1.25.

16. The diffuser pipe as defined in claim 2, wherein the stiffener includes a straight portion parallel to the ring;

the second end is disposed on a first axis;

a second axis is perpendicular to the first axis, the first and second axes being generally in plane with the at least flattened area;

the straight portion has a first thickness in a direction of the second axis;

the at least one stiffener raises at a second thickness relative to the at least one flattened area in a direction perpendicular to the first and second axes; and a ratio of the first thickness to the second thickness is comprised between 4.5and 5.

17. The diffuser pipe as defined in claim 1, wherein the stiffener is any one of D, T, I, X, H, O and Pi shaped.

18. A method of manufacturing a diffuser pipe of a gas turbine engine, the method comprising:

forming a hollow diffuser pipe body from at least one sheet metal;

a first end connected to a diffuser case, the first end defining an inlet cross-sectional area of the diffuser pipe;

a second end fluidly connected to the first end, the second end forming an elliptical cross-section having a major axis, the second end being a free end and defining an outlet cross-sectional area of the diffuser pipe, the outlet cross-sectional area being greater than the inlet cross-sectional area;

adding a raised structure on a flat portion of the diffuser pipe body near a free outlet end of the diffuser pipe body; and connecting a unitary formed ring to the free outlet end of the diffuser pipe body.

19. The method as defined in claim 18, wherein connecting the unitary formed ring to the free outlet end of the diffuser pipe body comprises welding a ring one of machined and cast to the free outlet end of the diffuser pipe body.

20. The method as defined in claim 18, wherein adding the raised structure on a flat portion of the diffuser pipe body includes stamping the flat portion of the diffuser pipe body into the raised portion.

21. A diffuser pipe for a gas turbine engine, the diffuser pipe comprising:

a hollow pipe body including:

a first end connected to a diffuser case, the first end defining an inlet cross-sectional area of the diffuser pipe;

a second end fluidly connected to the first end, the second end forming an elliptical cross-section having a major axis, the second end being a free end and defining an outlet cross-sectional area of the diffuser pipe, the outlet cross-sectional area being greater than the inlet cross-sectional area; and at least one flattened area proximate to the second end;

a ring connected to the second end, the ring being an outlet of the diffuser pipe; and at least one stiffener disposed on the at least one flattened area, the stiffener having a span in a direction of the major axis, the span being smaller than a span of the second end along the major axis.

* * * * *